US008398313B2

(12) United States Patent
Ihara et al.

(10) Patent No.: US 8,398,313 B2
(45) Date of Patent: Mar. 19, 2013

(54) LIQUID EJECTING HEAD AND LIQUID EJECTING APPARATUS

(75) Inventors: Yuki Ihara, Shiojiri (JP); Isamu Togashi, Matsumoto (JP); Yutaka Kobayashi, Ikeda-machi (JP)

(73) Assignee: Seiko Epson Corporation, Tokyo (JP)

( * ) Notice: Subject to any disclaimer, the term of this patent is extended or adjusted under 35 U.S.C. 154(b) by 290 days.

(21) Appl. No.: 13/009,451

(22) Filed: Jan. 19, 2011

(65) Prior Publication Data

US 2011/0187797 A1 Aug. 4, 2011

(30) Foreign Application Priority Data

Feb. 2, 2010 (JP) ..... 2010-021659

(51) Int. Cl.
*B41J 2/175* (2006.01)
*B41J 2/04* (2006.01)

(52) U.S. Cl. ..... 385/65; 347/42; 347/47

(58) Field of Classification Search ..... 347/65
See application file for complete search history.

(56) References Cited

U.S. PATENT DOCUMENTS

2006/0055732 A1* 3/2006 Ogawa et al. ..... 347/54

FOREIGN PATENT DOCUMENTS

JP 11-286110 10/1999
JP 2002-127406 5/2002

* cited by examiner

*Primary Examiner* — Jerry Rahll
(74) *Attorney, Agent, or Firm* — Workman Nydegger

(57) ABSTRACT

A liquid ejecting head is provided. The liquid injecting head includes two reservoirs. The reservoirs include expansion chambers arranged in parallel in a direction in which pressure chambers are arranged. Each reservoir includes multiple expansion chambers formed so that an inner wall surface of one of the reservoirs protrudes toward the other reservoir. Each expansion chamber having a liquid introduction opening. Constriction portions are formed so that the inner wall surface of one reservoir protrudes at locations that oppose the expansion chambers of the other reservoir. The constriction portions narrow the flow channel width in the direction intersecting with the direction in which the pressure chambers are arranged. The liquid introduction openings provided in the expansion chambers disposed on either side of the constriction portion are formed in locations that are at different distances from the constriction portion and have different cross-sectional areas.

4 Claims, 4 Drawing Sheets

LIQUID EJECTING HEAD AND LIQUID EJECTING APPARATUS

The entire disclosure of Japanese Patent Application No: 2010-021659, filed Feb. 2, 2010 are expressly incorporated by reference herein.

BACKGROUND

1. Technical Field

The present invention relates to liquid ejecting heads such as ink jet recording heads that eject liquid droplets from a nozzle using pressure fluctuations, and to liquid ejecting apparatuses provided with such liquid ejecting heads.

2. Related Art

Ink jet recording heads (called simply "recording heads" hereinafter) used in image recording apparatuses such as ink jet recording apparatuses (called simply "printers" hereinafter), coloring material ejecting heads used in the manufacture of color filters such as liquid-crystal displays, electrode material ejecting heads used in the formation of electrodes in organic EL (electroluminescence) displays and FEDs (field emission displays), bioorganic matter ejecting heads used in the manufacture of biochips (biochemical devices), and so on can be given as examples of liquid ejecting heads that eject a liquid within a pressure chamber as liquid droplets from a nozzle by causing a pressure fluctuation to occur.

The aforementioned recording head includes: a flow channel unit in which a serial liquid flow channel spanning from a reservoir to nozzles via respective pressure chambers is formed, where ink in liquid form is introduced from a liquid holding unit such as an ink cartridge that has been filled with ink; an actuator unit having a pressure generation element capable of causing a fluctuation in the volume of a pressure chamber; and so on. With a recording head in which multiple nozzles are arranged in a row and pressure chambers communicating with the nozzles are arranged along the nozzle row direction, the configuration is such that multiple ink supply openings that communicate with the pressure chambers are formed in the inner wall surface of the reservoir, which holds the ink to be introduced to the pressure chambers, on the side of the reservoir on which the pressure chambers are arranged; meanwhile, liquid introduction openings are provided in locations that face the center, in the lengthwise direction, of the inner wall surface on the opposite side, and ink introduced therefrom into the reservoir is supplied to the pressure chambers via the ink supply openings.

With recording heads configured with multiple pressure chambers arranged in this manner, an increase in the number of pressure chambers that are arranged causes the distance from the liquid introduction opening to increase the further the pressure chamber is toward the end in the arrangement direction, which leads to the risk that an insufficient amount of ink will be supplied. Meanwhile, although increasing the volume of the reservoir, increasing the diameter of the liquid introduction openings, or the like can be considered as a way to equalize the amount of ink supplied to the respective pressure chambers, doing so causes a problem in that the size of the recording head in the width direction thereof will increase. Accordingly, forming partition plates (branch portions) that cut across the liquid introduction openings that open into the reservoir in those liquid introduction openings has been proposed as a configuration that enables ink introduced from the liquid introduction openings to be stably supplied to the end of the pressure chamber arrangement direction in the reservoir without leading to an increase in the size of the recording head in the width direction (JP-A-11-286110).

However, with a recording head having a partition plate as described above, when two or more liquid introduction openings are formed in the reservoir, the flow of the ink stagnates in the area of an interflow region, where the inks introduced from the respective liquid introduction openings flow together, that is on the side opposite to the pressure chamber, and there has been a tendency for foam contained in the ink to build up in this stagnant area.

In addition, in the case where reservoirs are provided in parallel, even if an attempt is made to reduce the dimensions of the reservoirs in the width direction, it is necessary to form the liquid introduction openings as openings that protrude in order to stably supply the ink introduced from the liquid introduction openings to the end of the pressure chamber arrangement direction in the reservoirs, and it has not been possible to reduce the distance between adjacent parallel reservoirs in order to prevent the protruding cavities from interfering with each other. Furthermore, even if the wall surfaces that face the protruding cavities of the parallel reservoirs are sunk into the reservoirs in correspondence thereto, the flow channel width of the sunk areas will become narrower than the flow channel widths in other areas, and there has thus been a tendency for foam to build up in a stagnant area occurring around this sunk area, and in particular in the bottom of the sunk area. For this reason, when applying a pressure fluctuation to the pressure chambers and ejecting ink, the foam that has built up is sometimes introduced into the pressure chambers, thus causing ejection problems such as so-called "missing dots", in which ink is not ejected properly from the nozzles.

SUMMARY

An advantage of some aspects of the invention is to provide a liquid ejecting head and a liquid ejecting apparatus capable of achieving miniaturization while maintaining reliability.

A liquid ejecting head according to an aspect of the invention is a liquid ejecting head having multiple nozzles arranged in a row and pressure chambers communicating with respective nozzles arranged along a nozzle row direction, the liquid ejecting head ejecting a liquid that is filled in the pressure chambers from the nozzles by instigating pressure fluctuations within the pressure chambers through operations performed by a pressure generation unit. The liquid ejecting head includes two reservoirs, arranged in parallel in the direction in which the pressure chambers are arranged, that hold liquid to be introduced into the pressure chambers, and each reservoir has multiple expansion chambers formed so that an inner wall surface of one of the reservoirs protrudes toward the other reservoir that is arranged parallel to the one reservoir, each expansion chamber having a liquid introduction opening that introduces the liquid into the reservoir, and constriction portions formed so that the inner wall surface of the one reservoir protrudes into the one reservoir at locations that oppose the expansion chambers of the other reservoir that is arranged parallel to the one reservoir, the constriction portions narrowing the flow channel width in the direction intersecting with the direction in which the pressure chambers are arranged. The liquid introduction openings provided in the expansion chambers disposed on either side of the constriction portion are formed in locations that are at different distances from the constriction portion and are formed so as to have different cross-sectional areas.

According to this configuration, two reservoirs that are arranged in parallel in the direction in which the pressure chambers are arranged and that hold liquid to be introduced into the pressure chambers are provided, and each reservoir has multiple expansion chambers formed so that an inner wall surface of one of the reservoirs protrudes toward the other reservoir that is arranged parallel to the one reservoir, each expansion chamber having a liquid introduction opening that introduces the liquid into the reservoir, and constriction portions formed so that the inner wall surface of the one reservoir protrudes into the one reservoir at locations that oppose the expansion chambers of the other reservoir that is arranged parallel to the one reservoir, the constriction portions narrowing the flow channel width in the direction intersecting with the direction in which the pressure chambers are arranged; furthermore, the liquid introduction openings provided in the expansion chambers disposed on either side of the constriction portion are formed in locations that are at different distances from the constriction portion and are formed so as to have different cross-sectional areas. Accordingly, by appropriately setting the cross-sectional area of the liquid introduction openings, it is possible to position an interflow region in which the liquid introduced from the respective liquid introduction openings intermixes in the vicinity of the tip of the constriction portions, thus making it possible to suppress the buildup of foam occurring around the constriction portions, and in particular in the bottom thereof, where stagnation occurs in the flow. Accordingly, during liquid ejection, the occurrence of liquid droplet ejection problems caused by accumulated foam entering into the pressure generation chambers all at once can be suppressed.

In the aforementioned configuration, of the reservoirs arranged in parallel, tip portions of the expansion chambers in one of the reservoirs are disposed so as to enter into the constriction portions of the other reservoir.

According to this configuration, of the reservoirs arranged in parallel, tip portions of the expansion chambers in one of the reservoirs are disposed so as to enter into the constriction portions of the other reservoir, and thus the expansion chambers and the adjacent constriction portions of the reservoirs arranged in parallel are disposed so as to interlock in concavo-convex form; as a result, the distance between the reservoirs arranged in parallel can be reduced. Accordingly, the liquid ejecting head can be miniaturized while maintaining the reliability thereof.

In the aforementioned configuration, it is desirable for the expansion chambers disposed on either side of the constriction portion to be formed so that the cross-sectional area of the liquid introduction opening provided in the expansion chamber whose distance is further from the constriction portion is greater than the cross-sectional area of the liquid introduction opening provided in the expansion chamber whose distance from the constriction portion is closer.

According to this configuration, the expansion chambers disposed on either side of the constriction portion are formed so that the cross-sectional area of the liquid introduction opening provided in the expansion chamber whose distance is further from the constriction portion is greater than the cross-sectional area of the liquid introduction opening provided in the expansion chamber whose distance from the constriction portion is closer; accordingly, the flow amounts of the liquid moving from the liquid introduction openings toward the constriction portions can be adjusted regardless of the distance from the constriction portions, thus making it possible to position the interflow region of the liquid introduced from the liquid introduction openings at the ends of the constriction portions. As a result, the occurrence of stagnation in the flow around the constriction portion, and in particular in the bottom thereof, can be suppressed, and thus liquid droplet ejection problems occurring due to foam accumulating in the stagnant areas can be suppressed.

In addition, a liquid ejecting apparatus according to an aspect of the invention includes a liquid ejecting head configured as described above.

According to this configuration, a liquid ejecting head capable of suppressing the occurrence of ejection problems and achieving miniaturization is mounted, and thus a highly-reliable liquid ejecting apparatus can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. Note that in this embodiment, an ink jet recording apparatus (called a "printer" hereinafter) will be described as an example of a liquid ejecting apparatus, whereas an ink jet recording head (called a "recording head" hereinafter) will be described as an example of a liquid ejecting head.

Figure 1:
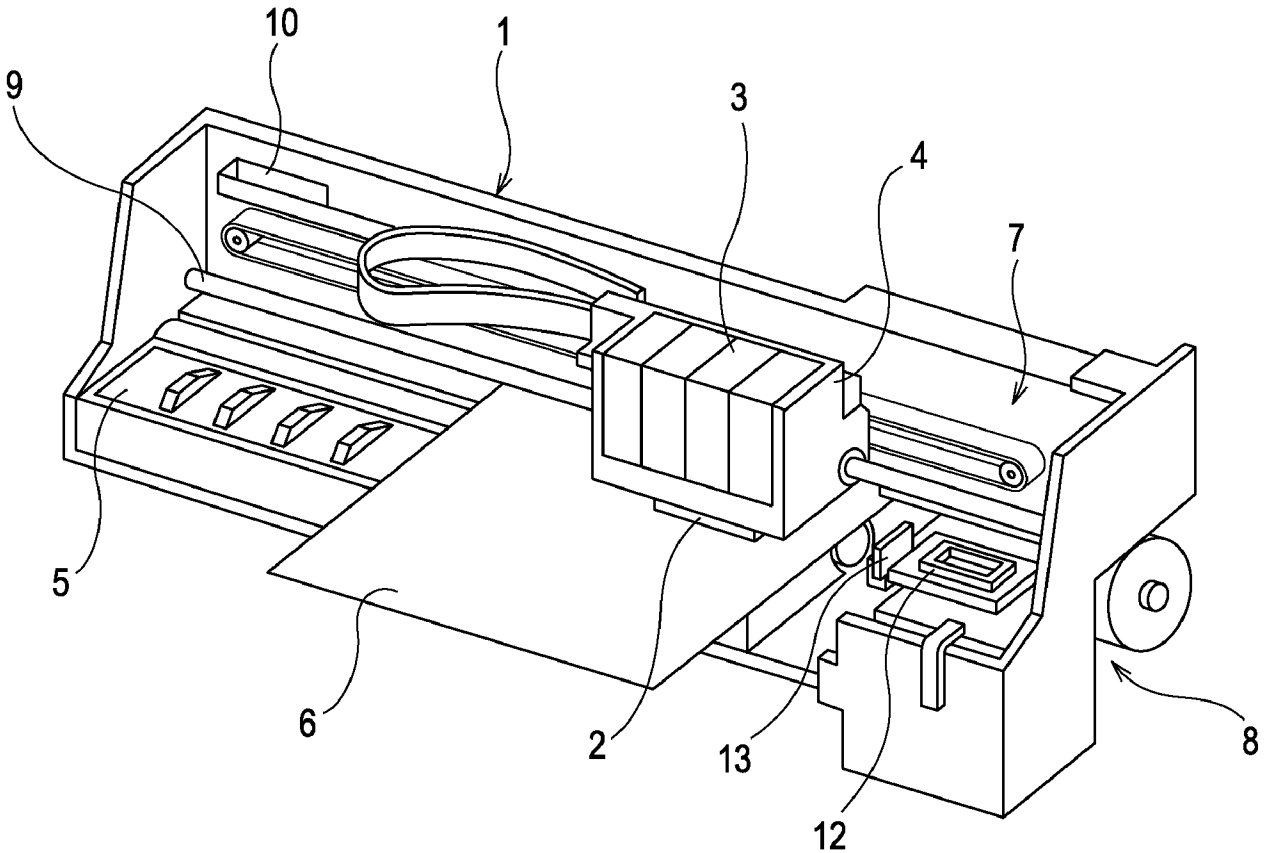
FIG. 1 is a perspective view illustrating the configuration of a printer.

FIG. 1 is a perspective view illustrating an ink jet recording apparatus. First, the overall configuration of an ink jet recording apparatus (called a "printer" hereinafter) in which a recording head is installed will be described with reference to FIG. 1. A printer 1 illustrated as an example here is generally configured so as to include a carriage 4 to which a recording head 2, which is a type of liquid ejecting head, is attached and to which ink cartridges 3 that hold ink (a type of liquid according to the invention) are attached in a removable state, a platen 5 disposed below the recording head 2, a carriage movement mechanism 7 that moves the carriage 4 in which the recording head 2 is installed along the paper width direction of recording paper 6 (a type of landing target), a paper feed mechanism 8 that transports the recording paper 6 in the paper feed direction, which is the direction that is perpendicular to the paper width direction, and so on. Here, the paper width direction is the main scanning direction (head scanning direction), whereas the paper feed direction is the sub scanning direction (in other words, the direction perpendicular to the head scanning direction).

The carriage 4 is attached in a state in which it is axially supported by a guide rod 9 that is provided along the main scanning direction, and the configuration is such that the carriage 4 moves in the main scanning direction along the guide rod 9 as a result of operations performed by the carriage movement mechanism 7. The position of the carriage 4 in the main scanning direction is detected by a linear encoder 10, and detection signals are sent to a control unit (not shown) as location information. Accordingly, the control unit can control recording operations (ejection operations) and the like of the recording head 2 while recognizing the scanning location of the carriage 4 (the recording head 2) based on the location information from the linear encoder 10.

A home position, which serves as a base point for scanning, is set within the movement range of the carriage 4 in an end region that is outside of the recording region (the right side in FIG. 1). A capping member 12 that seals a nozzle formation surface of the recording head 2 (that is, a nozzle plate 25; see FIG. 3) and a wiper member 13 for wiping the nozzle formation surface are provided at the home position in this embodiment. The printer 1 is configured so as to be capable of so-called bidirectional recording, in which text, images, or the like are recorded upon the recording paper 6 both when the carriage 4 (the recording head 2) is outbound, moving toward the end that is on the opposite side of the home position, and when the carriage 4 is inbound, returning toward the home position from the end that is on the opposite side of the home position.

Figure 2:
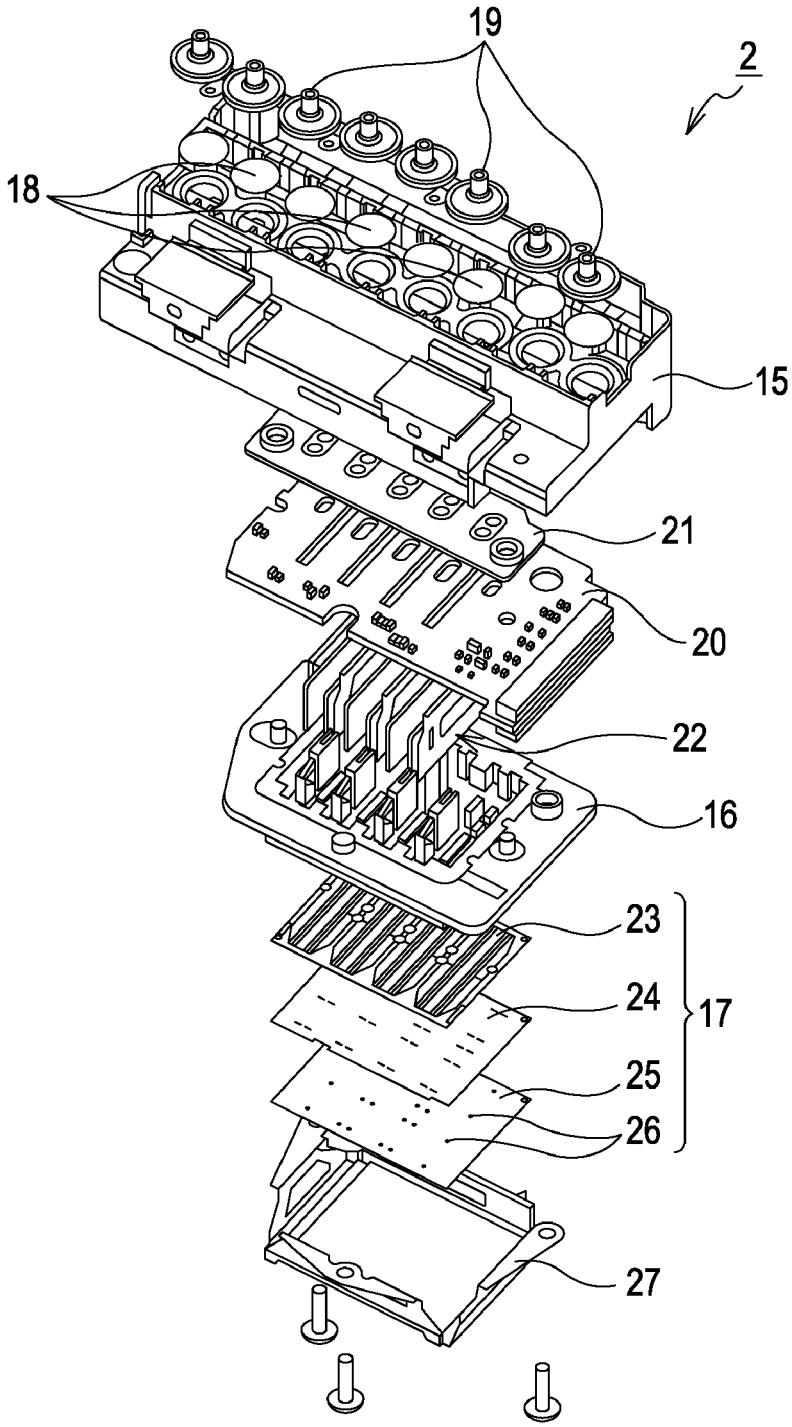
FIG. 2 is an exploded perspective view illustrating the configuration of a recording head.

Next, the configuration of the recording head 2 will be described. Here, FIG. 2 is an exploded perspective view illustrating the recording head 2 that is attached to the carriage 4. The recording head 2 illustrated in this example is generally configured of a cartridge base unit 15 (called a "base unit" hereinafter), a head case 16, a flow channel unit 17, a vibrator unit 22, and so on.

The base unit 15 is molded from, for example, a synthetic resin, and ink introduction needles 19 are attached to the upper surface thereof with respective filters 18 provided between the upper surface and the ink introduction needles 19. The ink cartridges 3 are mounted in these spaces. In other words, the ink cartridges 3 are mounted as being positioned in the base unit 15.

As shown in FIG. 2, a circuit board 20 is attached to the other surface of the base unit 15, which is on the opposite side as the aforementioned spaces. This circuit board 20 includes, for example, a drive circuit for controlling the supply of driving signals to piezoelectric vibration elements 29 (see FIG. 3), which will be discussed later, connectors for making connections to the printer itself, ink supply through-holes, and so on. The circuit board 20 is attached to the base unit 15 with a sheet member 21 that functions as packing.

The head case 16 is a casing, anchored to the base unit 15, that holds the vibrator unit 22, which in turn contains the piezoelectric vibration elements 29, which will be discussed later. Accordingly, a holding cavity 32 (see FIG. 3) capable of housing the vibrator unit 22 is formed in the head case 16. The vibrator unit 22 is inserted into this holding cavity 32 and is affixed thereto using an adhesive or the like. Meanwhile, the flow channel unit 17 is affixed, using an adhesive or the like, to the leading surface of the head case 16, which is on the opposite side as the surface of the head case 16 that is attached to the base unit 15.

The flow channel unit 17 is created as a single integrated entity by affixing a vibration plate (elastic plate) 23, a flow channel formation substrate 24, and the nozzle plate 25 to each other in a stacked state using an adhesive or the like.

The nozzle plate 25 is a thin stainless-steel plate in which multiple nozzle openings 26 (corresponding to "nozzles" according to the invention) are provided in a row at a pitch corresponding to a dot formation density. In this embodiment, for example, 180 nozzle openings 26 are provided in a row, and a nozzle row is thus formed by these nozzle openings 26. Furthermore, eight of these nozzle rows are provided side-by-side.

A head cover 27 is provided on the end of the head case 16, on the outside of and enclosing the edges of the nozzle plate 25. This head cover 27 is created from, for example, a thin, metallic plate member. The head cover 27 protects the end of the flow channel unit 17, the head case 16, and so on, and also functions so as to prevent the nozzle plate 25 from becoming charged.

Figure 3:
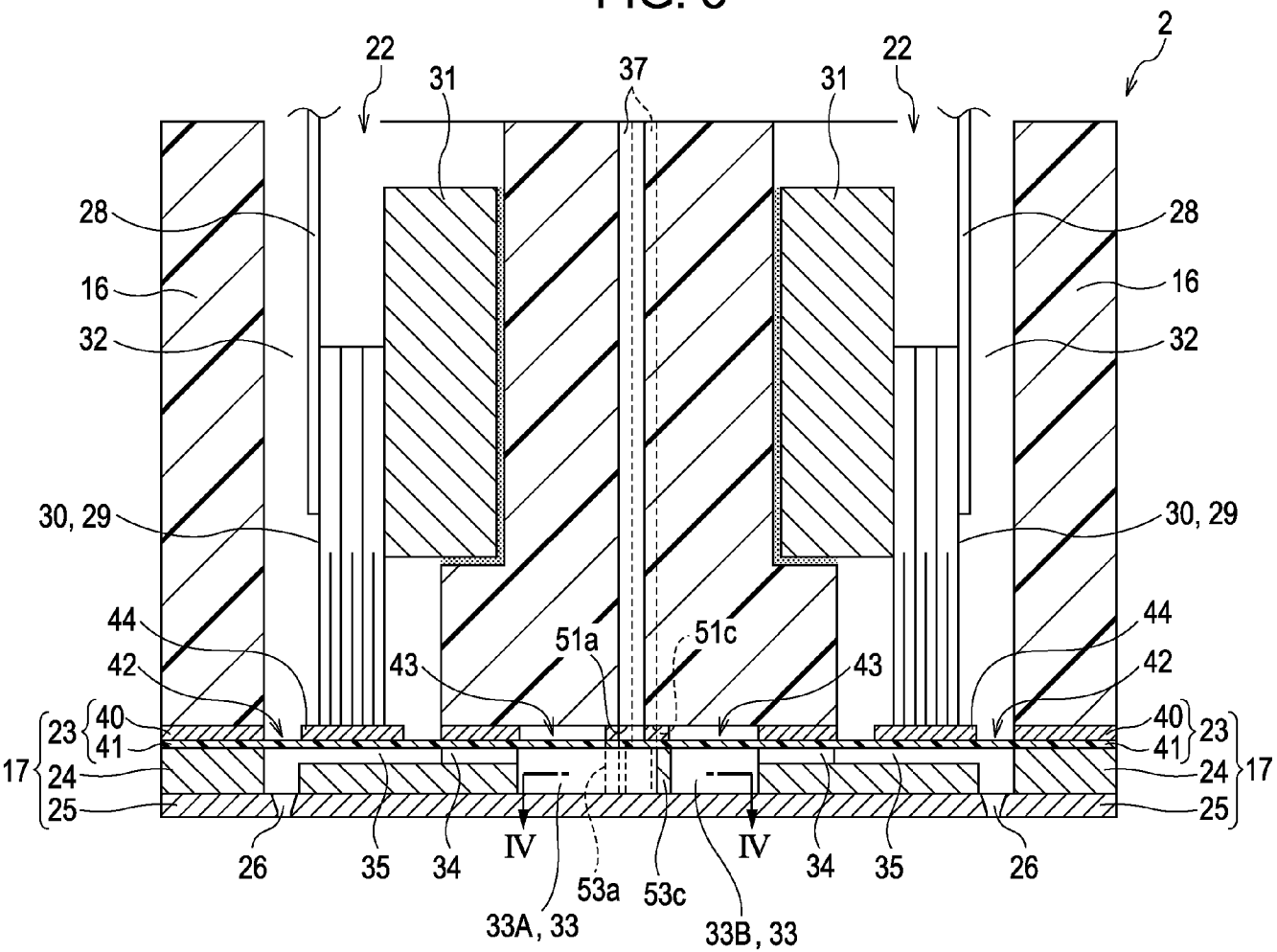
FIG. 3 is a cross-sectional view illustrating the principal constituent elements of a recording head.

FIG. 3 is a cross-sectional view illustrating the primary elements of the recording head 2, and illustrates two nozzle rows (pressure generation chambers). The aforementioned vibrator unit 22 is configured of a piezoelectric vibrator group 30, an anchor plate 31 to which the piezoelectric vibrator group 30 is affixed, a flexible cable 28 for supplying driving signals from the circuit board 20 to the piezoelectric vibrator group 30, and so on. The piezoelectric vibrator group 30 according to this embodiment includes multiple piezoelectric vibration elements 29 (corresponding to pressure generation units according to the invention) arranged in comb-tooth shape. Each of the piezoelectric vibration elements 29 has its anchored end affixed to the surface of the corresponding anchor plate 31, whereas the free end thereof protrudes outward further than the end surface of the corresponding anchor plate 31. In other words, each of the piezoelectric vibration elements 29 is attached to the corresponding anchor plate 31 in a so-called cantilever state. The flexible cable 28 is electrically connected to each of the piezoelectric vibration elements 29 on the side surface of the anchored end opposite to the anchor plate 31. In addition, the anchor plates 31 that support the respective piezoelectric vibration elements 29 are configured of, for example, stainless steel that is approximately 1 mm thick. Note that in addition to the aforementioned piezoelectric vibration elements, static electricity actuators, magnetostrictive devices, thermal elements, or the like can be used as the pressure generation units.

A holding cavity 32 capable of holding the aforementioned vibrator unit 22 is formed within the head case 16 so as to pass through the head case 16 in the height direction thereof. The rear surface of the anchor plate 31 is affixed to a case inner wall surface that defines the holding cavity 32, and thus the vibrator unit 22 is stored and anchored within the holding cavity 32. In addition, a case flow channel 37 is formed in the head case 16, passing therethrough in the height direction. The case flow channel 37 is a flow channel for supplying ink from the ink cartridges 3 to a common ink chamber 33.

The flow channel formation substrate 24 is a plate-shaped member that forms a serial ink flow channel configured of the common ink chamber 33 (corresponding to a reservoir according to the invention), an ink supply opening 34, and a pressure generation chamber 35 (corresponding to a pressure chamber according to the invention). To be more specific, the flow channel formation substrate 24 is a plate-shaped member in which multiple cavities serving as pressure generation chambers 35 and separated by partition walls are formed along the nozzle row direction (indicated by the symbol "X" hereinafter) in correspondence with respective nozzle openings 26, and in which cavities serving as the ink supply opening 34 and the common ink chamber 33 are formed as well. The flow channel formation substrate 24 according to this embodiment is created by etching a silicon wafer; the upper openings of the cavities are sealed by the vibration plate 23, whereas the lower openings are sealed by the nozzle plate 25. The aforementioned pressure generation chambers 35 are formed as long, thin chambers extending perpendicularly relative to the direction in which the nozzle openings 26 are formed (the nozzle row direction), and the ink supply opening 34 is formed as a constricting portion, having a narrow flow width, that communicates between the pressure generation chamber 35 and the common ink chamber 33. Meanwhile, the common ink chamber 33 is a chamber that communicates with ink introduction channels (not shown) of the ink introduction needles 19 via the case flow channel 37 that is formed so as to pass through the head case 16 in the height direction thereof and is used for supplying ink held in the ink cartridges 3 to the respective pressure generation chambers 35, and communicates with pressure generation chambers 35 through corresponding ink supply openings 34. Accordingly, the ink introduced into this common ink chamber 33 is supplied to the pressure generation chambers 35 through the ink supply openings 34. The common ink chamber 33 will be described in detail later.

The vibration plate 23 is a compound plate having a dual-layer construction in which a resin film 41 such as PPS (polyphenylene sulfide) has been laminated upon a metallic support plate 40 configured of stainless steel or the like, and is a member that has a diaphragm portion 42, sealing one of the open sides of the pressure generation chamber 35, for varying the capacity of the pressure generation chamber 35, and a compliance portion 43 that seals one of the open sides of the common ink chamber 33. The diaphragm portion 42 is configured by etching the support plate 40 in a location corresponding to the pressure generation chamber 35 so as to remove a ring-shaped portion from that location, thereby forming an insular portion 44 to be joined with the free end of the piezoelectric vibration element 29. Similar to the planar shape of the pressure generation chamber 35, the insular portion 44 has a long, thin block shape extending perpendicularly relative to the direction in which the nozzle openings 26 are arranged, and the resin film 41 surrounding the insular portion 44 functions as an elastic membrane. Meanwhile, the portion functioning as the compliance portion 43, or in other words, the portion corresponding to the common ink chamber 33, is configured only of the resin film 41, with the support plate 40 having been completely removed through etching based on the shape of the opening of the common ink chamber 33.

Because the end surface of the piezoelectric vibration element 29 is bonded to the insular portion 44, the volume of the pressure generation chamber 35 can be changed by causing the free end of the piezoelectric vibration element 29 to expand/shrink. Pressure fluctuations occur in the ink within the pressure generation chamber 35 as a result of this volume change. The recording head 2 ejects ink droplets from the nozzle openings 26 using this pressure fluctuation.

Figure 4:
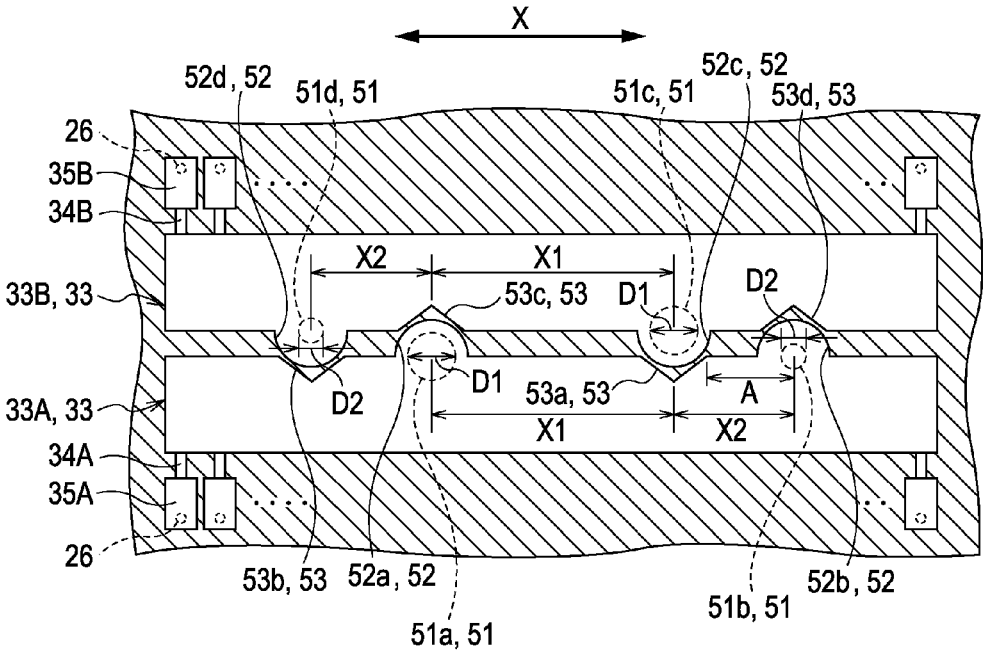
FIG. 4 is a plan view illustrating common ink chambers provided in parallel.

Next, the configuration of the common ink chamber 33 according to this embodiment will be described. FIG. 4 is a plan view illustrating two common ink chambers 33A and 33B, which are common ink chambers 33, arranged in parallel. The aforementioned recording head 2 includes two common ink chambers 33, which are long, thin chambers that hold ink to be introduced into respective pressure generation chambers 35, provided in parallel along the direction in which the pressure generation chambers 35 are arranged (the same direction as the nozzle row direction; hereinafter, indicated by the symbol "X"). Note that in this embodiment, two common ink chambers 33 are taken as a pair, and four pairs are arranged in a row, for a total of eight common ink chambers 33.

Of the common ink chambers 33 arranged in parallel, one of the common ink chambers (called a "first common ink chamber 33A" hereinafter) has multiple ink supply openings 34A opened in the inner wall surface of the first common ink chamber 33A that is on the side opposite to the other common ink chamber (called a "second common ink chamber 33B" hereinafter) arranged parallel to the first common ink chamber 33A; furthermore, pressure generation chambers 35A that communicate with the first common ink chamber 33A via respective ink supply openings 34A are provided in a row. Furthermore, the second common ink chamber 33B is disposed in a state in which pressure generation chambers 35B that communicate with the second common ink chamber 33B via respective ink supply openings 34B are provided in a row on the side opposite to the first common ink chamber 33A.

A first expansion chamber 52*a*, formed so as to protrude (expand) toward the second common ink chamber 33B, is provided in the inner wall surface located on the side of the first common ink chamber 33A that is opposite to the pressure generation chambers 35 in a location corresponding to approximately ⅔ of the entire length from one end thereof (the left end in FIG. 4) in the lengthwise direction, whereas a second expansion chamber 52*b*, formed so as to protrude (expand) toward the second common ink chamber 33B, is provided in a location corresponding to approximately ⅙ of the entire length from the other end (the right end in FIG. 4) in the lengthwise direction. A first constriction portion 53*a*, formed in the inner wall surface so as to protrude (sink) into the first common ink chamber 33A, is provided in a location that is between the first expansion chamber 52*a* and the second expansion chamber 52*b* and is approximately ⅔ of the entire length from the other end in the lengthwise direction, whereas a second constriction portion 53*b*, formed in the inner wall surface so as to protrude (sink) into the first common ink chamber 33A, is provided in a location that is approximately ⅙ of the entire length from the one end in the lengthwise direction.

A third expansion chamber 52*c*, formed so as to protrude (expand) toward the first common ink chamber 33A, is provided in the inner wall surface located on the side of the second common ink chamber 33B that is opposite to the pressure generation chambers 35 in a location corresponding to approximately ⅔ of the entire length from one end thereof (the right end in FIG. 4) in the lengthwise direction, whereas a fourth expansion chamber 52*d*, formed so as to protrude (expand) toward the first common ink chamber 33A, is provided in a location corresponding to approximately ⅙ of the entire length from the other end (the left end in FIG. 4) in the lengthwise direction. A third constriction portion 53*c*, formed in the inner wall surface so as to protrude (sink) into the second common ink chamber 33B, is provided in a location that is between the third expansion chamber 52*c* and the fourth expansion chamber 52*d* and is approximately ⅔ of the entire length from the other end in the lengthwise direction, whereas a fourth constriction portion 53*d*, formed in the inner wall surface so as to protrude (sink) into the second common ink chamber 33B, is provided in a location that is approximately ⅙ of the entire length from the one end (the right end in FIG. 4) in the lengthwise direction and that opposes the second expansion chamber 52*b* of the first common ink chamber 33A. In this manner, the expansion chambers and constriction portions are disposed so as to oppose each other.

The first expansion chamber 52*a* and the second expansion chamber 52*b* are formed as cross-sectional half circles (as seen from above in FIG. 4) that have the same cross-sectional areas, and part of the tips thereof are disposed so as to enter into the third constriction portion 53*c* and the fourth constriction portion 53*d*, respectively, of the second common ink chamber 33B. A first ink introduction opening 51*a* (corresponding to a liquid introduction opening according to the invention), formed as a concentric circle with the half circle that is the first expansion chamber 52*a*, is provided in the upper surface side of the first expansion chamber 52*a*, whereas a second ink introduction opening 51*b* (having a diameter D2 of, for example, 0.08 mm) whose cross-sectional area is less than that of the first ink introduction opening 51*a* (whose diameter D1 is, for example, 1.26 mm) and that is formed as a concentric circle with the half circle that is the second expansion chamber 52*b*, is provided in the upper surface side of the second expansion chamber 52*b*.

The first ink introduction opening 51*a* and the second ink introduction opening 51*b* are openings on one end of the case flow channel 37 in the first common ink chamber 33A. The ink within the ink cartridges 3 that has been supplied via the case flow channel 37 is introduced into the first expansion chamber 52*a* and the second expansion chamber 52*b* formed in this manner through the ink introduction openings 51. Note that the third expansion chamber 52*c* and fourth expansion chamber 52*d* are formed in the same shapes as the first expansion chamber 52*a* and the second expansion chamber 52*b*, are disposed so as to oppose the first constriction portion 53*a* and the second constriction portion 53*b* of the first common ink chamber 33A, and part of the tips thereof enter into the constriction portions of the first common ink chamber 33A. Furthermore, in the second common ink chamber 33B, the surface area of a third ink introduction opening 51*c* of the third expansion chamber 52*c* is set so as to be greater than the surface area of a fourth ink introduction opening 51*d* of the fourth expansion chamber 52*d*.

The first constriction portion 53*a* and the second constriction portion 53*b* are formed in a cross-sectional triangular shape (as seen from above in FIG. 4), and by protruding into the first common ink chamber 33A, reduce the flow channel width of the first common ink chamber 33A in the direction intersecting with (vertical to) the pressure generation chamber arrangement direction X more than in other areas. Accordingly, the flow channel cross-section of the areas in which the constriction portions are formed is smaller than the other areas. Note that the third constriction portion 53*c* and the fourth constriction portion 53*d* are formed in the same shape as the first constriction portion 53*a* and the second constriction portion 53*b*, respectively, and thus the flow channel width of the second common ink chamber 33B in the direction intersecting with (vertical to) the pressure generation chamber arrangement direction X is narrower than in other areas.

The tips of the first expansion chamber 52*a* and the second expansion chamber 52*b* in the first common ink chamber 33A configured in this manner enter into the respective base portions of the third constriction portion 53*c* and the fourth constriction portion 53*d* of the second common ink chamber 33B, and the tips of the third expansion chamber 52*c* and the fourth expansion chamber 52*d* of the second common ink chamber 33B enter into the respective base portions of the first constriction portion 53*a* and the second constriction portion 53*b*; accordingly, even if expansion chambers that protrude are formed, the distance between the first common ink chamber 33A and the second common ink chamber 33B can be reduced. Accordingly, the recording head 2 can be miniaturized.

In addition, the first ink introduction opening 51*a* provided in the first expansion chamber 52*a* and the second ink introduction opening 51*b* provided in the second expansion chamber 52*b* disposed on both sides of the first constriction portion 53*a* are disposed in the respective expansion chambers as described earlier; the opening diameters (cross-sectional areas) thereof are formed so as to be different from each other, and are formed at locations whose distances from the first constriction portion 53*a* are different as well. In other words, the distance from the first constriction portion 53*a* to the first expansion chamber 52*a* (indicated by the symbol "X1" in FIG. 4) is set so as to be longer than the distance from the first constriction portion 53*a* to the second expansion chamber 52*b* (indicated by the symbol "X2" in FIG. 4), and thus the first ink introduction opening 51*a* provided in the first expansion chamber 52*a* whose distance X1 from the first constriction portion 53*a* is further is disposed in a position that is further from the first constriction portion 53*a* than the second ink introduction opening 51*b* provided in the second expansion chamber 52*b* whose distance X2 from the first constriction portion 53*a* is closer. The cross-sectional area of the first ink introduction opening 51*a* that is further from the first constriction portion 53*a* is set so as to be greater than that of the second ink introduction opening 51*b* that is closer. Note that the distance X1 from the first constriction portion 53*a* to the first ink introduction opening 51*a* is set to, for example, 1 mm.

Next, the flow of ink that enters into the first common ink chamber 33A formed in this manner will be described. First, because the cross-sectional area of the first ink introduction opening 51*a* in the first expansion chamber 52*a* whose distance X1 from the first constriction portion 53*a* is further is set so as to be greater than the cross-sectional area of the second ink introduction opening 51*b* provided in the second expansion chamber 52*b* whose distance X2 from the first constriction portion 53*a* is closer, the flow amount of the ink that flows from the first ink introduction opening 51*a* is greater than the flow amount of the ink that flows from the second ink introduction opening 51*b*, and the ink that flows from the ink introduction opening 51*a* provided in the first expansion chamber 52*a* and the ink that flows from the ink introduction opening 51*b* provided in the second expansion chamber 52*b* intermix in the vicinity of the end of the first constriction portion 53*a* based on the difference in the ink flow amounts. Accordingly, in the ink interflow region, the occurrence of stagnation in the ink flow around the first constriction portion 53*a*, and in particular in the bottom thereof, is suppressed more than in the case where stagnation occurs in the ink flow on the opposite side of the pressure generation chamber 35, and thus foam contained in the ink can be suppressed from accumulating in the stagnant area. Accordingly, during ink ejection, the occurrence of ink droplet ejection problems caused by accumulated foam entering into the pressure generation chamber 35 all at once can be suppressed. Furthermore, because the flow channel width is constricted near the tip of the first constriction portion, the ink flow speed increases more than in other areas, and thus the dischargibility of the foam is improved.

Furthermore, as mentioned earlier, the expansion chambers 52 and the adjacent constriction portions 53 of the first common ink chamber 33A and the second common ink chamber 33B arranged in parallel are disposed so as to interlock in concavo-convex form, and thus the distance between the first common ink chamber 33A and the second common ink chamber 33B arranged in parallel can be reduced, thus ensuring sufficient strength without an insufficient amount of thickness between the two. Accordingly, the recording head 2 can be miniaturized while maintaining the reliability thereof.

In this manner, the printer 1 according to the invention includes the recording head 2, which is capable of suppressing the occurrence of ejection problems while miniaturizing the recording head 2; accordingly, an increase in the speed of printing can be realized while also improving the printing quality and improving the reliability.

Incidentally, the invention is not limited to the above-described embodiment, and many variations based on the content of the appended claims are possible.

For example, although in the aforementioned embodiment describes an exemplary configuration in which the first constriction portion 53*a* and the second constriction portion 53*b* are formed so that the inner wall surface of the first common ink chamber 33A is caused to protrude (sink) into the first common ink chamber 33A in a cross-sectional triangular shape (as seen from above in FIG. 4) in positions that oppose the third expansion chamber 52*c* and the fourth expansion chamber 52*d* of the second common ink chamber 33B, the configuration is not limited thereto, and configuration may be such that the first constriction portion 53*a* and the second constriction portion 53*b* are formed so that the inner wall surface of the first common ink chamber 33A is caused to protrude (sink) into the first common ink chamber 33A in a cross-sectional half-hexagonal shape (as seen from above in FIG. 4) in positions that oppose the third expansion chamber 52*c* and the fourth expansion chamber 52*d* of the second common ink chamber 33B. In other words, the accumulation of foam in the stagnant area of ink occurring at the base of the first constriction portion 53*a* can be suppressed regardless of what cross-sectional shape the first constriction portion 53*a* has.

Furthermore, although a piezoelectric vibration element 29 in a so-called longitudinally-vibrating mode is described in the above embodiments as an example of a pressure generation unit, the pressure generation unit is not limited thereto. For example, the invention can also be applied when using a piezoelectric vibration element in a so-called flexural vibration mode.

Finally, the invention is not limited to a printer, and can be applied in a plotter, a facsimile apparatus, a copy machine, or the like; various types of ink jet recording apparatuses; liquid ejecting apparatuses aside from recording apparatuses, such as, for example, display manufacturing apparatuses, electrode manufacturing apparatuses, chip manufacturing apparatuses; and so on.

What is claimed is:

1. A liquid ejecting head having multiple nozzles arranged in a row and pressure chambers communicating with respective nozzles arranged along a nozzle row direction, the liquid ejecting head ejecting a liquid that is filled in the pressure chambers from the nozzles by instigating pressure fluctuations within the pressure chambers through operations performed by a pressure generation unit, and the liquid ejecting head comprising:

two reservoirs, arranged in parallel in the direction in which the pressure chambers are arranged, that hold liquid to be introduced into the pressure chambers, wherein each reservoir includes:

multiple expansion chambers formed so that an inner wall surface of one of the reservoirs protrudes toward the other reservoir that is arranged parallel to the one reservoir, each expansion chamber having a liquid introduction opening that introduces the liquid into the reservoir; and constriction portions formed so that the inner wall surface of the one reservoir protrudes into the one reservoir at locations that oppose the expansion chambers of the other reservoir that is arranged parallel to the one reservoir, the constriction portions narrowing the flow channel width in the direction intersecting with the direction in which the pressure chambers are arranged, and the liquid introduction openings provided in the expansion chambers disposed on either side of the constriction portion are formed in locations that are at different distances from the constriction portion and are formed so as to have different cross-sectional areas.

2. The liquid ejecting head according to claim 1, wherein of the reservoirs arranged in parallel, tip portions of the expansion chambers in one of the reservoirs are disposed so as to enter into the constriction portions of the other reservoir.

3. The liquid ejecting head according to claim 1, wherein the expansion chambers disposed on either side of the constriction portion are formed so that the cross-sectional area of the liquid introduction opening provided in the expansion chamber whose distance is further from the constriction portion is greater than the cross-sectional area of the liquid introduction opening provided in the expansion chamber whose distance from the constriction portion is closer.

4. A liquid ejecting apparatus comprising the liquid ejecting head according to claim 1.

* * * * *